US006488332B1

(12) United States Patent
Markwald

(10) Patent No.: US 6,488,332 B1
(45) **Date of Patent: *Dec. 3, 2002**

(54) TRAVELING SEAT

(75) Inventor: Michael Markwald, Eitorf (DE)

(73) Assignee: Interco Gesellschaft fur die Planung und den Vertrieb von Reha Hilfen mbH, Eitorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/176,719

(22) Filed: Oct. 21, 1998

(30) Foreign Application Priority Data

Oct. 21, 1997 (DE) ..... 297 18 696 U

(51) Int. Cl.[7] ..... A47C 1/02

(52) U.S. Cl. ..... 297/68; 297/DIG. 4; 297/317

(58) Field of Search ..... 297/317, 320, 297/322, 343, 342, DIG. 4, 68

(56) References Cited

U.S. PATENT DOCUMENTS

| | | | | | |
|---|---|---|---|---|---|
| 967,665 | A | * | 8/1910 | Piche | 297/317 |
| 1,964,519 | A | * | 6/1934 | Knudsen | 297/317 |
| 2,303,308 | A | * | 11/1942 | McArthur | 297/320 |
| 2,427,405 | A | | 9/1947 | Heaton | |
| 2,976,868 | A | | 3/1961 | Weissenberg | |
| 3,773,383 | A | | 11/1973 | Ekornes | |
| 4,004,836 | A | | 1/1977 | Kristensson | |
| 4,039,223 | A | | 8/1977 | Kristensson | |
| 4,268,054 | A | * | 5/1981 | Twitchell et al. | 297/DIG. 4 X |
| 4,364,603 | A | * | 12/1982 | Johnson | 297/68 X |
| 4,451,082 | A | * | 5/1984 | Giordani | 297/68 X |
| 4,761,033 | A | * | 8/1988 | Lanuzzi et al. | 297/320 X |
| 5,314,240 | A | * | 5/1994 | Ishi et al. | 297/452.15 |
| 5,358,266 | A | * | 10/1994 | Roth et al. | 297/DIG. 4 X |
| 5,904,398 | A | * | 5/1999 | Farricielli | 297/DIG. 4 X |
| 5,918,944 | A | * | 7/1999 | Dietrich | 297/68 X |

FOREIGN PATENT DOCUMENTS

| | | |
|---|---|---|
| DE | 2153417 | 5/1972 |
| DE | 2123081 | 6/1972 |
| DE | 31 45 568 A1 | 11/1981 |
| DE | 3902694 | 8/1990 |
| EP | 0 338 051 B1 | 6/1993 |
| EP | 0 552 219 B1 | 12/1996 |
| GB | 2 171 898 | 2/1986 |
| GB | 2 171 898 | 9/1986 |

OTHER PUBLICATIONS

English Abstract for application No. DE 3145568.
Das Relaxing Active System, Product Description, Elano Seating.
Pierson International Catalog Description, Models 621, 623, 321, and 323.

(List continued on next page.)

*Primary Examiner*—Peter M. Cuomo
*Assistant Examiner*—Stephen Vu
(74) *Attorney, Agent, or Firm*—Choate, Hall & Stewart

(57) ABSTRACT

Described herein is a traveling seat, such as a wheelchair, for physically handicapped persons. The seat has a seat shell mounted on a frame, where the shell includes a backrest and a seat surface, connected with one another with articulation, with a footrest being articulated pivotably to the forward end of the seat surface. In order to provide a seat that can follow the bodily movements caused by spasms of the person seated in the seat, the seat surface and backrest are connected, freely pivotably, with one another. A tensioning device generating a tensioning force that holds the seat surface and the backrest in the bent sitting position relative to one another is provided. In addition, the footrest is articulated in a freely pivotable fashion to the seat surface, with a tensioning device generating the tensioning force that holds the footrest in the bent sitting position relative to the seat surface.

29 Claims, 2 Drawing Sheets

OTHER PUBLICATIONS

Atoform Impala, Product Description.
Ortopedia Qualitätsproduckte helfen weiter, Elektrorollstühle, Faltrollstühle, Aktiv–u. Sportrollstühle, Rehabilitationsmittel, Product Description.
Qualitätsproduckte fur mehr Mobilität, Handgetriebene Rollstühle, Toiletten–und Duschrollstühle, Elektro–Rollstühle, Citymobile, Zubehör, 1998.
Levo Campact LC, product description.
Test & Teknik: Compact LC und active LA con Levo im Rollstuhltest, I'm Still Standing, von Peter Mand, Paraplegic 2, 1993, pp. 30–31.
Meyra Rollstühle und Rehabilitationsmittel, Model 3.405–00–92, 3.40–12–92, codes 658, 655, 594, 746, 92, 100, model 2.312, codes 515–518, 590/591, 162, 163, 139, 138, 639, 820, 828, 855, 57, 58, 90, 91, 92, 93.

Reba NormBingen, Saturn, product description.

Sitzschalenrollstuhl Spectum, Däger Rehabilitationstechnik, Product Description.

Rehabilitation Frühförderung–Tagesstätte–Schule–Zuhause, Gehrmeyer–Schuchmann Produkte Zum Ledeh.

Stressless Product Description.

Design of a Dynamic Seating System for Clients with Extensor Spasms, Ault et al, RESNA, Jun. 20–24, 1997.

A Bit of Freedom for Full–Body Extensor Thrust –A Non–Static Positioning Approach, Patrick S. Conner, Jan. 23–25, 1997, Thirteenth International Seating Symposium.

* cited by examiner

TRAVELING SEAT

BACKGROUND OF THE INVENTION

1. Field of the Invention

This invention relates to a traveling seat and more particularly relates to a traveling seat especially for physically handicapped persons having a frame fastened to a seat shell.

2. Description of Related Art

Traveling seats used for transporting individuals are known. For example, strollers may be used to transport small children. In this case, a frame has a bar located approximately 1.20 m above the surface on which the wheels of the frame stand. The bar may be grasped by a person to move the stroller. Depending on the type of the stroller, it may be equipped with three or four wheels, with one or two of said wheels being articulated in a steerable manner to the frame.

Another type of traveling seat is a wheelchair. In contrast to a stroller, a wheelchair tends to have larger rear wheels that can be operated by hand by the person seated in the wheelchair. However, some wheelchairs may be equipped only with small wheels, thus requiring a care giver to push them using handles or a bar mounted at a suitable height.

Some types of seats, such as those used for strollers, include a seat shell with a backrest and footrest articulated to the seat surface. The seat back and footrest pivot relative to the seat surface and can be locked in certain positions, so that the posture of the person sitting on the seat shell can be varied from an upright position, with the upper body and knees bent, to a nearly straight lying position. Seat shells of this type are used, for example, for alternative mounting on a stroller or on a mounting device in an automobile, so that they can be used as child seats.

SUMMARY OF THE INVENTION

According to the present invention, the backrest and footrest are both coupled to the seat surface via a pivot. A tensioning device creates a tensioning force that disposes the seat surface, backrest and footrest in a configuration appropriate for sitting.

The seat according to the invention is especially provided to hold persons who suffer from spasms. In these patients, uncontrolled impulses are delivered to the muscles that result in a cramp-like tensing of the muscles which generally causes the body to stretch out. In other words, the seated person actuates his muscles in such fashion that the hip joints and knee joints are straightened. To prevent the patient from falling out of the seat shell of the seat, generally the patient is held on the seat shell by restraining means, comprising a lap belt or lap bar for example. In conventional seats, the patient is restrained in a rigid seat or seat shell that is adjustable and can be locked in position. During a spastic attack, the muscles exert forces on the restraining means which hold the joints of the patient in the bent position and secure the patient in the seated position. Because the tensing of the muscles cannot lead to a stretching of the body, the muscles and ligaments that bind the joints are subjected to high mechanical stress. In addition, the full muscular force is exerted on the fastening means and the seat shell resulting in considerable mechanical stress on these items.

The device described herein allows the back rest and seat surface to pivot when subjected to a muscular force. The footrest, too, can pivot into alignment with the seat surface. Thus, in spite of the restraining devices, the seat permits the body to straighten in response to tensing of the muscles. The mechanical stresses on the muscles and on the ligaments of the patient, as well as on the seat surface and the footrest are considerably reduced. Since the patient is also preferably restrained in the seat shell by at least one lap belt, it is not possible for the patient to fall out of the seat.

Tensioning devices produce a tensioning force that holds the seat shell and the footrest in the sitting position at least until the person to be accommodated is seated. Advantageously, a sufficiently high tensioning force may be produced to counteract the muscular force and to brake the stretching movement so that excessively rapid stretching of the body does not occur. As a result, the risk of injury to the seated person and of damage to the articulated connections on reaching their end stops is reduced.

A locking device may be provided that inhibits the pivoting of the seat shell and/or footrest when such pivoting is not desired. Such might be the case, for example, when a patient in a wheelchair is pushed into a cramped elevator where injury might result if seat parts were to pivot. In addition, the contact surface of the backrest may also be extended from the seat surface, parallel to the principal plane of the backrest, with a tensioning device again being provided that holds the contact surface in the position closest to the seat surface. During complete stretching of the patient's body, the distance between the shoulder part and the point where the feet contact the footrest generally increases; the device described herein accounts for this, and allows the seat (e.g., as part of a wheelchair) to completely follow the stretching movement. A locking device can also be provided to inhibit motion of the backrest.

The tensioning devices are preferably constructed using tensioning springs. These springs may be designed as either tension springs or compression springs, depending on the articulation points for the tensioning springs. In some cases, coil springs made of steel may be used. Gas springs are also suitable for this application. Other tensioning devices are also possible, weights for example, that press the individual parts of the seat into the original bent sitting position by gravity.

The contact surface of the backrest, while remaining movable, may be connected directly to the lower part of the backrest so that the sliding guide for the contact surface is integrated into the backrest. Preferably, however, a sliding guide may be articulated to a rear strut of the frame in which the contact surface of the backrest is guided. This provides that even when the backrest pivots relative to the seat surface, the backrest is supported by the articulation point on the frame and hence the forces exerted by the weights and the muscular forces are reliably transmitted to the frame. The tensioning springs that form a pretensioning device for the movable contact surface may be integrated into the sliding guide. A sliding guide is preferably attached to the frame below the seat surface, with the seat surface being articulated to the movable part of the guide. A tensioning spring subjected to tension engages the movable part, said spring pulling the seat surface backward, i.e. toward the backrest, so that the seat surface and the backrest are pulled into the bent sitting position. It may be desirable to provide a stop for the pivoting movement of the elements of the seat shell and the footrest and for the translational motion of the contact surface of the backrest in order to prevent the parts from being moved excessively by muscular force, which could damage the tensioning devices or could allow the patient sitting on the seat to be injured.

The seat surface and the backrest of the seat shell may be made of load-carrying shell-like structures such as steel or plastic and may be provided with thick, comfortable cushions. In order to prevent the cushion from being jammed when the seat back is pivoted relative to the seat surface, a cover strip may be provided for covering the rear edge of the seat surface and the lower edge of the backrest. The cover strip may prevent the cushions mounted on the seat surface and the backrest from entering the above gap. Advantageously, the cover strip may be mounted in the vicinity of the two edges, i.e. the edges of the seat surface and the backrest, and may slide in the vicinity of the other edges.

Further advantages and features of the invention follow from the description of the drawings below and the claims.

DETAILED DESCRIPTION OF THE PREFERRED EMBODIMENT(S)

Figure 2:
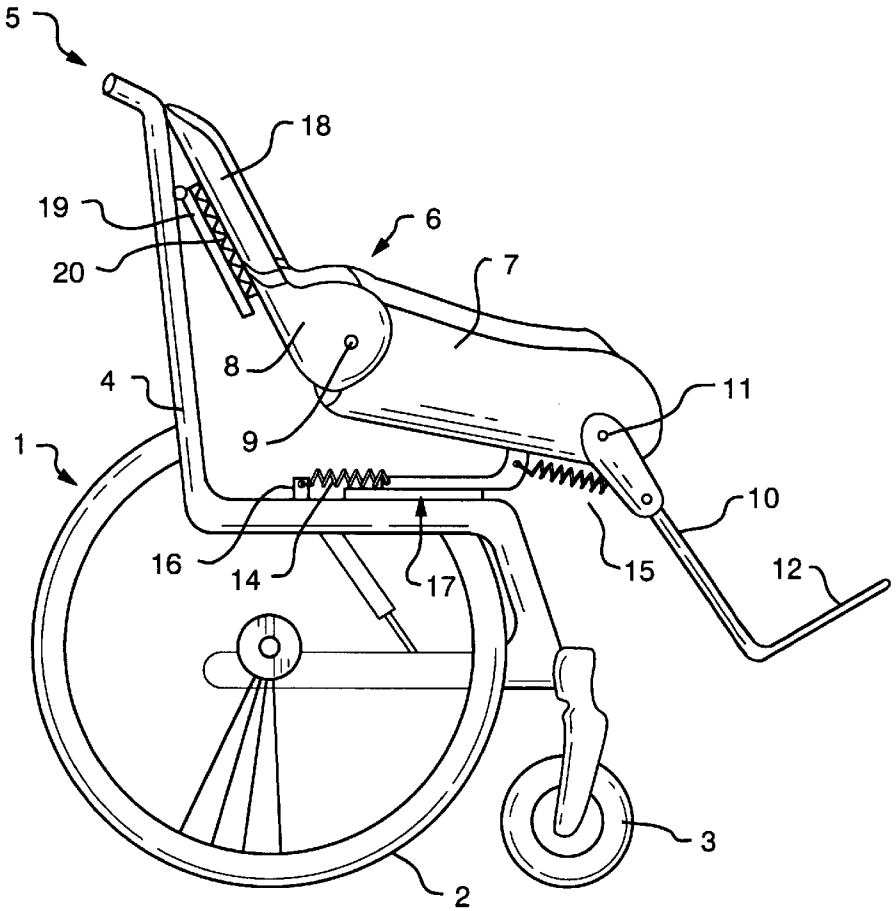
FIG. 2 is a view of the seat of FIG. 1, with a seat shell and footrest extended against tensioning force of tensioning devices.
Figure 1:
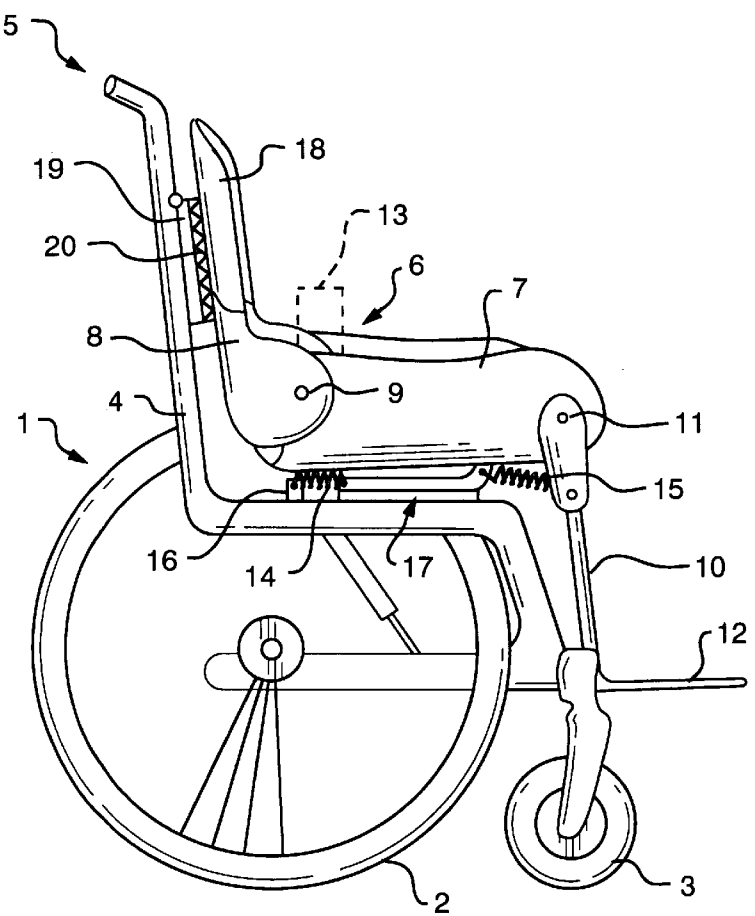
FIG. 1 shows an embodiment of a seat according to the invention in the form of a wheelchair, in a side view in an unloaded initial position.

The seat shown in FIGS. 1 and 2, in the form of a wheelchair, includes a frame 1 consisting of large rear wheels 2 located on both sides of the frame 1. A person seated in the wheelchair can operate the wheels 2 by hand. Small front wheels 3 are pivotably articulated on both sides of the frame 1 to facilitate turning of the wheelchair. An upper part of the frame 1 is designed in the form of a double L-shaped frame 4 as viewed from the side. At an upper end of the parallel L-shaped frame 4, a strut 5 that extends horizontally is provided for grasping by a standing person to push the wheelchair. A plurality of transverse struts (not shown) extend crosswise with respect to the plane of the drawing between the two L-shaped frames stabilize the frame 1.

A seat shell 6 rests on the L-shaped frame 4. The seat shell 6 includes a seat surface 7 and a backrest 8 which are pivotably connected with one another to pivot about an axis 9. The pivot axis 9 may be formed by connecting elements, bolts or rivets for example, fitted into lateral wall segments of the seat surface 7 and the backrest 8. The connecting elements may be located on both sides of the seat shell 6 and may have a common axis, such as the pivot axis 9.

A footrest 10 is articulated pivotably about a pivot axis 11 at a forward end of the seat surface 7 in the two lateral wall sections. The footrest 10 includes two struts parallel to one another, only one of which is visible in FIGS. 1 and 2 in a side view. The footrest 12 can be continuous or can include two individual footrests, each of which is fastened to one of the struts. The struts may be telescopic to accommodate different leg sizes of persons sitting in the chair.

In order to make the seat comfortable, cushions (not shown) may be provided on the seat surface 7 and the backrest 8. Since the seat is intended primarily for accommodating a person suffering from spasms, fastening means may be provided to secure the person in the seat shell 6. The latter may be primarily a pelvic retainer, for example a lap belt or lap bar whose approximate position is indicated in FIG. 1 by dashed lines 13. In addition, fastening means, belts, or back pads can also be provided on the backrest 8. On the seat surface 7, abduction belts or wedges may be provided to secure the legs, for example.

It is shown in FIG. 2 that the seat can follow a stretching movement of the person sitting in the seat shell 6. The person can pivot the footrest 10 forward by muscular force and pivot the backrest 8 rearward relative to the seat surface 7. A pair of tensioning devices 14, 15 are provided which pull the movable parts of the seat into the sitting position shown in FIG. 1. The first tensioning device 14 includes a tension spring fastened at one end to a receiving block 16 attached to the L-shaped frame and at the other end to the seat surface 7. Connection to the seat surface 7 is made by a linear guide 17 below the seat surface 7. A lower part of the linear guide 17 is attached to the L-shaped frame 4. A forward end of an upper part is connected pivotably with an underside of the seat surface 7. The tensioning device 14 is articulated at a rear end of an upper part of the linear guide 17. Thus, the tensioning device 14 pulls the seat surface 7 into the rear position and thus draws the seat shell 6 into a bent position such as that shown in FIG. 1. The tensioning device 15 likewise includes a tension spring, located between the leg support 10 and the upper part of the linear guide 17. The tensioning device 15 pulls the footrest 10 into a rear bent position such as that shown in FIG. 1.

The linear guide 17 and the tensioning devices 14, 15 are shown only schematically in the drawings. In practice, the guide 17 and the devices 14,15 may be made sufficiently large so as to account for both the force of gravity and the muscular forces of the person in the seat. Depending on the required tensioning force of the tensioning devices 14, 15, a plurality of tensioning springs may be provided parallel to one another. In addition, stops (not shown) may be provided for the pivoting movement of the seat shell 6 as well as the footrest 10 so that the position of the seat shown in FIG. 2 may be the maximum extent of the pivoting.

In FIGS. 1 and 2, another adjusting mechanism is shown for following a stretching movement of the person seated in the seat. The backrest 8 includes an upper portion that is extendable in a vertical direction (FIG. 1). The portion may form a contact surface 18 for the shoulder area of the person to be seated. The backrest 8 may be connected by the movable contact surface 18 with the rear strut of the L-shaped frame 4 of the frame 1. The connection may be formed by a sliding guide 19 which in turn includes a tensioning device 20, which shown as a compression spring. During powerful stretching of the seated person, this person may be in contact with the foot support 12 so that his shoulders move upward. This movement may be followed by the movable contact surface 18.

Figure 3:
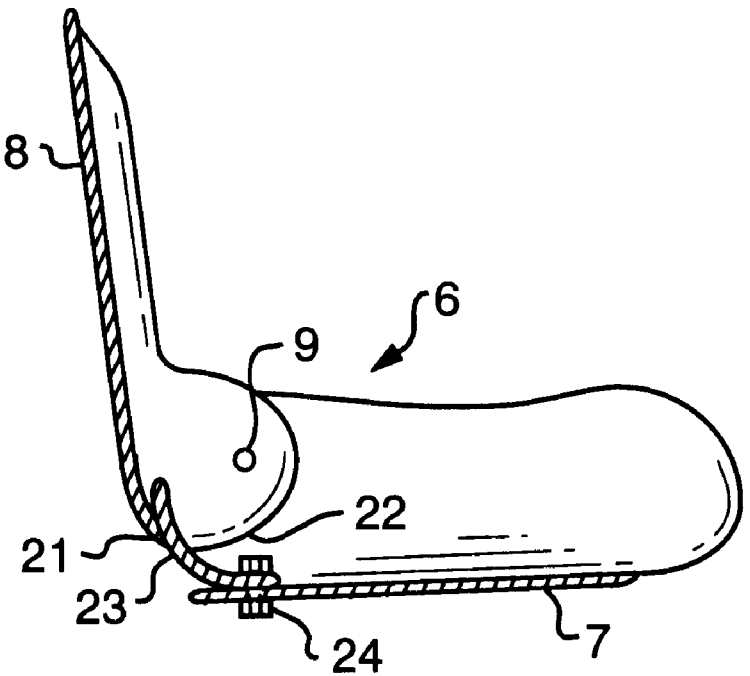
FIG. 3 is a section through the seat shell of the seat of FIGS. 1 and 2.

FIG. 3 shows a cross section through the seat shell 6 without any cushions. To avoid a cushion from becoming jammed between the lower edge 21 of the backrest 8 and the rear edge 22 of the seat, a cover strip 23 may be provided that is fastened by connecting rivets 24 near a rear edge 22 of the seat surface and that abuts the backrest in a sliding fashion in the vicinity of a lower edge 21. A cover strip 23 preferably includes a plastic strip several millimeters thick that can flexibly follow the pivoting movement of the backrest 8 relative to the seat surface 7.

While the invention has been disclosed in connection to the preferred embodiments shown and described in detail, various modifications and improvements thereon will become readily apparent to those skilled in the art. Accordingly, the spirit and scope of the present invention is to be limited only by the following claims.

What is claimed is:

1. A traveling seat, comprising:

a frame;

a shell fastened to said frame and including a backrest and a footrest that are freely pivotably actuatable through a range of positions from a bent sitting position to a position of maximum extent;

a first tensioning device, coupled to said shell to bias said backrest and said footrest back to the bent sitting position through said range of positions wherein said first tensioning device biases said backrest and said footrest back to the bent sitting position when said backrest and said footrest are at the position of maximum extent;

a mobility mechanism, coupled to said frame, to provide for movement of the traveling seat;

wherein said shell includes a seat part and wherein said backrest and said footrest are pivotably attached to said seat part;

a displaceable contact surface corresponding to an upper portion of said backrest; and a second tensioning device coupled to said contact to maintain a relative position of said contact surface.

2. The traveling seat, according to claim 1, further comprising:

a pelvic restraint, coupled to said shell, to secure a person to said shell.

3. The traveling seat, according to claim 1, wherein said first tensioning device includes at least one tensioning spring.

4. The traveling seat, according to claim 3, wherein said first tensioning device includes two springs and wherein one of said springs is coupled to said footrest.

5. The traveling seat, according to claim 4, wherein said second tensioning device includes at least one tensioning spring.

6. The traveling seat, according to claim 4, further comprising:

a sliding guide that is pivotably articulated at a rear strut of the frame and guides the contact surface.

7. A traveling seat comprising:

a frame;

a shell fastened to said frame and including a backrest and a footrest that are freely pivotably actuatable through a range of positions from a bent sitting position to a position of maximum extent;

a first tensioning device, coupled to said shell bias said backrest and said footrest back to the bent sitting position through said range of positions, wherein said first tensioning device biases said backrest and said footrest back to the bent sitting position when said backrest and said footrest are at the position of maximum extent;

a mobility mechanism, coupled to said frame, to provide for movement of the traveling seat;

wherein said shell includes a seat part and wherein said backrest and said footrest are pivotably attached to said seat part;

a linear guide disposed below said seat part to couple said seat part to said frame.

8. The traveling seat, according to claim 7, wherein said first tensioning device includes at least one tensioning spring.

9. The traveling seat, according claim 8, wherein said first tensioning device includes two spring and wherein one of said springs is coupled to said footrest.

10. The traveling seat, according to claim 7, further comprising: a pelvic restraint, coupled to said shell, to secure said person to said shell.

11. A traveling seat, comprising:

a frame;

a shell fastened to said frame and including a backrest and a footrest that are freely pivotably actuable through a range of positions from a bent sitting position to a position of maximum extent;

a first tensioning device, coupled to said shell to bias said backrest and said footrest back to the bent sitting position through said range of positions, wherein said first tensioning device biases said backrest and said footrest back to the bent sitting position when said backrest and said footrest are at the position of maximum extent; a mobility mechanism, coupled to said frame, to provide for movement of the traveling seat;

wherein said shell includes seat part and wherein said backrest and said footrest are pivotably attached to said seat part; and cover strip that covers a gap between a rear edge of said surface and a lower edge of said backrest.

12. The traveling seat, according to claim 11, wherein said first tensioning device includes at least one tensioning spring.

13. The traveling seat, according to claim 12, wherein said shell includes a seat part and wherein said backrest and said footrest are pivotably attached to said seat part.

14. The traveling seat, according to claim 11, further comprising:

a pelvic restraint, coupled to said shell, to secure a person to said shell.

15. The traveling seat, according to claim 14, further comprising:

a linear guide disposed below said seat part to provide for lateral motion of said seat part.

16. A traveling seat, comprising:

a frame;

a shell fastened to said frame and including a backrest and a footrest that are freely pivotably actuatable through a range of positions from a bent sitting position to a position of maximum extent in response to force applied by an occupant of the traveling seat;

a first tensioning device coupled to the shell to bias said backrest and said footrest back to the bent sitting position through said range of positions, wherein said first tensioning device biases said backrest and said footrest back to the bent sitting position when said backrest and said footrest are at the position of maximum extent;

wheels coupled to said frame to transport the traveling seat; and wherein said shell includes a seat part and wherein said backrest and said footrest are pivotably attached to said seat part; and a linear guide disposed below said seat part to couple said seat part to said frame.

17. The traveling seat, according to claim 12, further comprising:

a displaceable contact surface coupled to said backrest; and a second tensioning device coupled to said contact surface to maintain a relative position of said contact surface.

18. A traveling seat, comprising:

a frame;

a shell fastened to said frame and including a backrest and a footrest that are freely pivotably actuatable through a range of positions from a bent sitting position to a position of maximum extent in response to force applied by an occupant of the traveling seat;

a first tensioning device coupled to the shell to bias said backrest and said footrest back to the bent sitting position through said range of positions, wherein said first tensioning device biases said backrest and said footrest back to the bent sitting position when said backrest and said footrest are at the position of maximum extent;

wheels coupled to said frame to transport the traveling seat;

a displaceable contact surface coupled to said backrest; and a second tensioning device coupled to said contact surface to maintain a relative position of said contact surface.

19. The traveling seat, according to claim 18, wherein said shell includes a seat part and wherein said backrest and said footrest are pivotably attached to said seat part.

20. A traveling seat, comprising:

a seat part;

a backrest, pivotably coupled to said seat part;

a footrest, pivotably coupled to said seat part, said backrest and said footrest being pivotably actuatable through a range of positions from a bent sitting position to a position of maximum extent;

a first tensioning device, coupled to said seat part to bias said backrest and said footrest back to the bent sitting position through said range of positions, wherein said first tensioning device to the bent said backrest and said footrest back to the bent sitting position when said backrest and said footrest are at the position of maximum extent;

transporting means for providing movement of said traveling seat;

a displaceable contact surface corresponding to an upper portion of said backrest; and a second tensioning device coupled to said contact surface to maintain a relative position of said contact surface.

21. The traveling seat, according to claim 16, further comprising:

said linear guide disposed below said seat part to provide for lateral motion of said seat part.

22. A mobile chair comprising:

a frame;

a shell fastened to the frame, said shell including a seat part with a linear guide disposed below a surface of said seat part coupling said seat part to said frame;

means for absorbing muscular forces of a person in the mobile shair, said means for absorbing muscular forces including a movable backrest and a footrest that are freely pivotably actuatable through a range of positions from a bent sitting position to a position of maximum extent;

a tensioning device coupled to the shell to bias the backrest and the footrest back to the bent sitting position through said range of positions, wherein said tensioning device biases said backrest and said footrest back to the bent sitting position when said backrest and said footrest are at the position of maximum extent; and means, coupled to said frame, for transporting said mobile chair.

23. A traveling seat, comprising:

a frame;

a shell fastened to said frame and including a backrest and a footrest that are freely pivotably actuatable through a range of positions from a bent sitting position to a position of maximum extent, said shell including a seat part, wherein a linear guide is disposed below a surface of said seat coupling said seat part to said frame;

a first tensioning device, coupled to said shell to bias said backrest and said footrest in the bent sitting position through said range of positions, wherein said first tensioning device biases said backrest and said footrest back to the bent sitting position when said backrest and said footrest are at the maximum extent; and a mobility mechanism, coupled to said frame, to provide for movement of the traveling seat.

24. The traveling seat, according to claim 23, wherein the seat part is articulated to the moveable part of said linear guide.

25. The traveling seat, according to claim 23, wherein said first tensioning device includes at least one tensioning spring.

26. The traveling seat, according to claim 25, wherein said first tensioning device includes two springs and wherein one of said springs is coupled to said footrest.

27. The traveling seat, according to claim 23, further comprising:

a displaceable contact surface corresponding to an upper portion of said backrest; and a second tensioning device coupled to said contact surface to maintain a relative position of said contact surface.

28. The traveling seat, according to claim 27, wherein said second tensioning device includes at least one tensioning spring.

29. The traveling seat, according to claim 27, further comprising:

a sliding guide that is pivotably articulated at a rear strut of the frame and guides the contact surface.

* * * * *